US011466957B1

(12) United States Patent
Liu

(10) Patent No.: US 11,466,957 B1
(45) Date of Patent: Oct. 11, 2022

(54) CROSSBOW STRING DRAWING ASSIST SYSTEM

(71) Applicant: Chi-Chang Liu, Taichung (TW)

(72) Inventor: Chi-Chang Liu, Taichung (TW)

(73) Assignee: POE LANG ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 17/673,742

(22) Filed: Feb. 16, 2022

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
CPC ..... F41B 5/12; F41B 5/123; F41B 5/1469
See application file for complete search history.

(56) References Cited

U.S. PATENT DOCUMENTS 7,100,590 B2 * 9/2006 Chang ..... F41B 5/123 124/25
9,752,844 B1 * 9/2017 Huang ..... F41B 5/12
10,295,299 B2 * 5/2019 Vergara ..... F41B 5/1469
10,948,257 B1 * 3/2021 Huang ..... F41B 5/1449
11,015,892 B1 * 5/2021 Jessup ..... F41A 17/20
11,067,357 B1 * 7/2021 Chu ..... F41B 5/1449
2006/0163258 A1 * 7/2006 Fisher ..... B65D 88/005 220/507
2009/0277435 A1 * 11/2009 Pestrue ..... F41B 5/12 124/1
2015/0040883 A1 * 2/2015 McPherson ..... F41B 5/1469 124/88
2019/0033033 A1 * 1/2019 Vergara ..... F41B 5/12

* cited by examiner

*Primary Examiner* — John A Ricci

(57) ABSTRACT

A crossbow string drawing assistance system includes a crossbow, a bowstring drawing assistance device and a wire separator assembly, the bowstring drawing assistance device and the wire separator assembly are mounted on different positions of the crossbow, a pull hook of the bowstring drawing assistance device can hook a bowstring of the crossbow, a pull wire is inserted through the two hooks to engage with the wire separator assembly; when the bowstring drawing assistance device continuously packs the pull wire, the pull wire on the wire separator assembly is engaged to force the bowstring to move toward the wire separator assembly until the bowstring is engaged with the engaging member, so as to complete a drawing operation. Therefore, a user can mount and dismount the bowstring drawing assistance device easily according to habit, so as to mount the bowstring drawing assistance device in a comfortable position.

5 Claims, 7 Drawing Sheets

CROSSBOW STRING DRAWING ASSIST SYSTEM

BACKGROUND OF THE INVENTION

1. Field of the Invention

The present invention is related to a crossbow string drawing assist system.

2. Description of the Related Art

The crossbow is mainly formed by a frame body and a bow part. When in use, a user must draw a bowstring backwardly to engage and position the bowstring with an engaging member, so that the bow part is bent and deformed by the tension of the bowstring; next, the user places an arrow on the frame body to attach the stretched bowstring; the user can push a trigger to release the bowstring from the engaging member, at this time, the bow part bounces back to its original state because the pull force disappears, thereby driving the bowstring to form a great shooting force and shoot the arrows placed on the frame body quickly.

Because of the high tension of the bowstring of the crossbow, in order to draw the bowstring, the user must make the crossbow touch the ground and then draw the bowstring by hands and feet, and usually only person with great arm strength is able to draw the bowstring, so the operation is quite inconvenient. In order to enable the user to easily draw the bowstring of the crossbow, some manufacturers developed a bowstring drawing assistance device for a crossbow, to assist in drawing and engaging the bowstring of the crossbow.

The conventional bowstring drawing assistance device for the crossbow in the market is usually a one-piece structure. With this structure, the bowstring drawing assistance device is limited to mount on a position with specific angle only because of a limitation in an angle of a wire separator device thereof when the user wants to mount the bowstring drawing assistance device on the crossbow; otherwise, in the process of using the bowstring drawing assistance device, the pull wire may be stuck on the bowstring drawing assistance device, and the crossbow fails to pull back the pull wire effectively, so it causes the problem that the user fails to save the effort to pack the wire when using the bowstring drawing assistance device.

in addition, the conventional bowstring drawing assistance device is quite difficult to mount, dismount and manufacture due to the structure of the wire separator device thereof; furthermore, the bowstring drawing assistance device is an optional device for some people, so people may need to waste a lot of time to mount the bowstring drawing assistance device or need to use different crossbow, and it results in a lot of troubles.

Therefore, what is needed is to develop an improved bowstring drawing assistance device for crossbow to solve the above problems and provide more flexible manner of mounting and dismounting the bowstring drawing assistance device on the crossbow and adjusting the mounting position, so as to effectively help the user obtain a better comfortable experience in appearance, weight and use.

SUMMARY OF THE INVENTION

An objective of the present invention is to provide a crossbow string drawing assistance system, and in the crossbow string drawing assistance system, a wire separator assembly and a bowstring drawing assistance device are mounted on different positions of a crossbow, a pull hook is used to hook a bowstring, a pull wire is inserted through two hooks to engaged on the wire separator assembly, so that a nearly straight pull wire can be formed between the two hooks and the wire separator assembly; when the bowstring drawing assistance device continuously packs the pull wire, the pull wire on the wire separator assembly is engaged to force the bowstring to move toward the wire separator assembly until the bowstring is engaged with the engaging member, thereby completing a drawing operation.

In addition, the wire separator assembly and the bowstring drawing assistance device are mounted on the crossbow separately, so the bowstring drawing assistance device is prevented from being affected by the wire separator assembly, and the bowstring drawing assistance device can be mounted at any position on the crossbow, and the difficulty in mounting and dismounting is also reduced relatively, thereby enabling the user to mount and dismount the bowstring drawing assistance device and adjust a position of the bowstring drawing assistance device according to a habit.

In order to achieve the objective and effect, the present invention provides a crossbow string drawing assistance system including a crossbow, a bowstring drawing assistance device and a wire separator assembly. The crossbow includes a bow part, a frame part and a handle part, wherein the bow part is disposed on a section of the frame part and includes a bowstring, the handle part is connected to another section of the frame part, the frame part includes an engaging member. The bowstring drawing assistance device is disposed on the crossbow, and includes a reeling assembly, a pull wire and a pull hook, wherein the pull wire is inserted through the pull hook to connect to the reeling assembly. The wire separator assembly is disposed on the crossbow, and configured to separate and restrain the pull wire, to form a bowstring drawing structure between the pull hook and the wire separator assembly. When the pull hook hooks the bowstring to locate a part of the pull wire in the wire separator assembly, the reeling assembly is configured to draw back and pack the pull wire located two sides of the crossbow, to draw the bowstring to move toward the wire separator assembly through the pull hook until the bowstring is engaged with the engaging member, so as to complete a drawing operation.

In practical use, when the user wants to use the crossbow string drawing assistance system, the user can mount the bowstring drawing assistance device on a position according to habit, and hook the bowstring on the pull hook, draw the pull wire between the two pull hook backwardly to engage with the wire separator assembly on the crossbow; after the above-mentioned operations are completed, the user can operate the reeling assembly to pull back and pack the pull wire, and during the process of pulling back the pull wire, the pull wire between the wire separator assembly and the two pull hooks is stretched and gradually reduce the length, so as to drive the bowstring to move toward the wire separator assembly until the pull wire is engaged on the engaging member, thereby completing the whole drawing operation.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
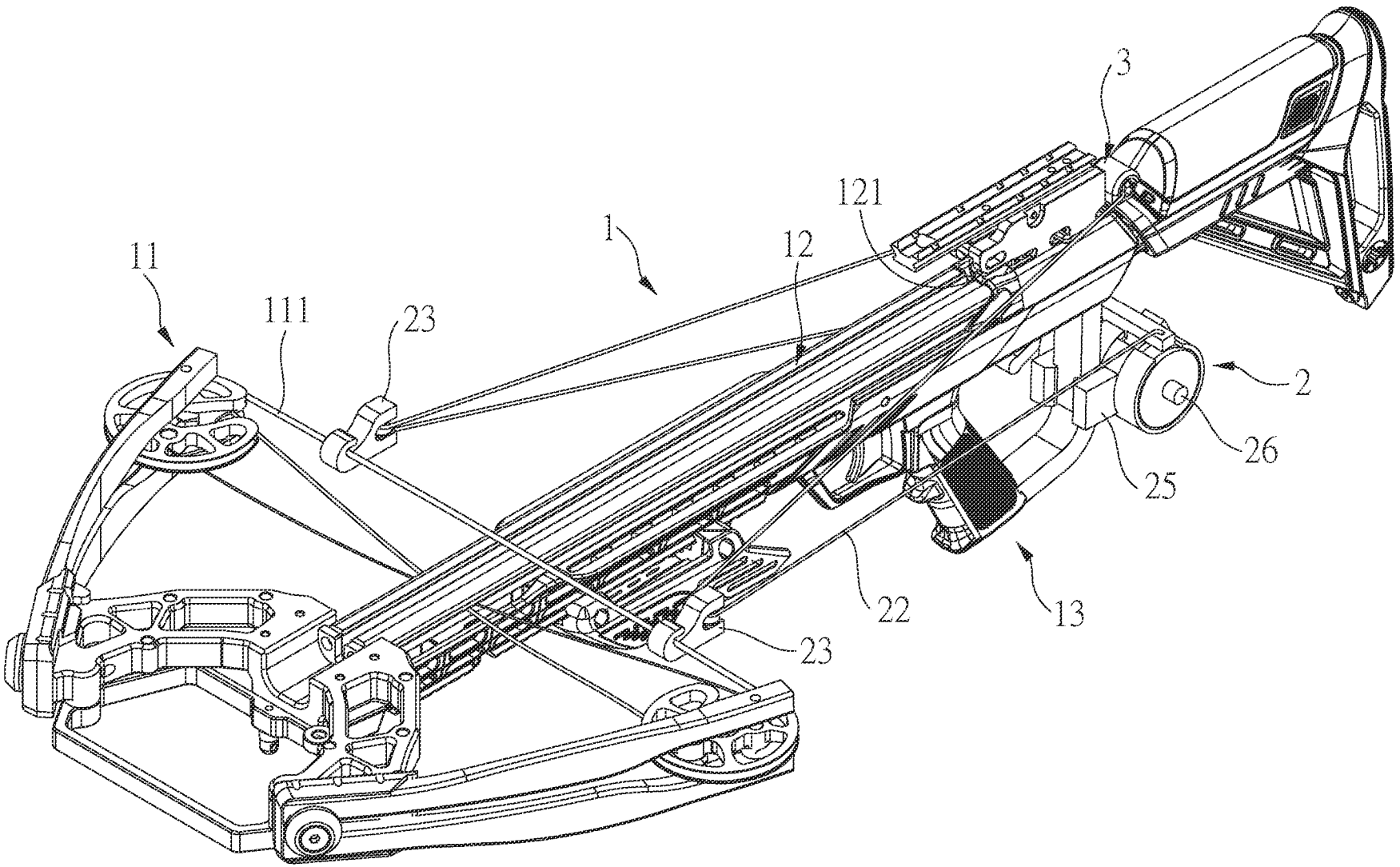
FIG. 1 is a perspective view of an embodiment of the present invention.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims.

These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts. As used herein, the singular forms "a", "an" and "the" are intended to include the plural forms as well, unless the context clearly indicates otherwise.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the words "comprise" and "include", and variations such as "comprises", "comprising", "includes", or "including", will be acknowledged to imply the inclusion of stated elements but not the exclusion of any other elements.

As shown FIGS. 1 to 7, The present invention is related to a crossbow string drawing assistance system includes a crossbow 1, a bowstring drawing assistance device 2 and a wire separator assembly 3. The crossbow 1 includes a bow part 11, a frame part 12, and a handle part 13; the bow part 11 is disposed on a section of the frame part 12 and includes a bowstring 111; the handle part 13 is connected to another section of the frame part 12, and the frame part 12 includes an engaging member 121.

Figure 5:
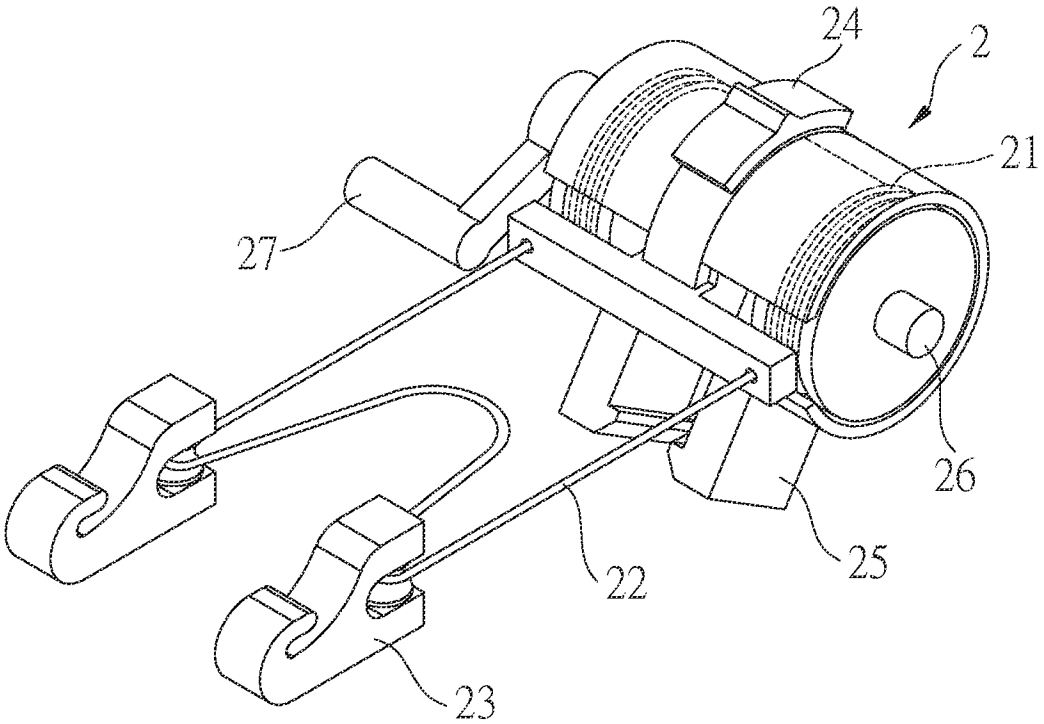
FIG. 5 is a perspective view of a bowstring drawing assistance device of the present invention.
Figure 6:
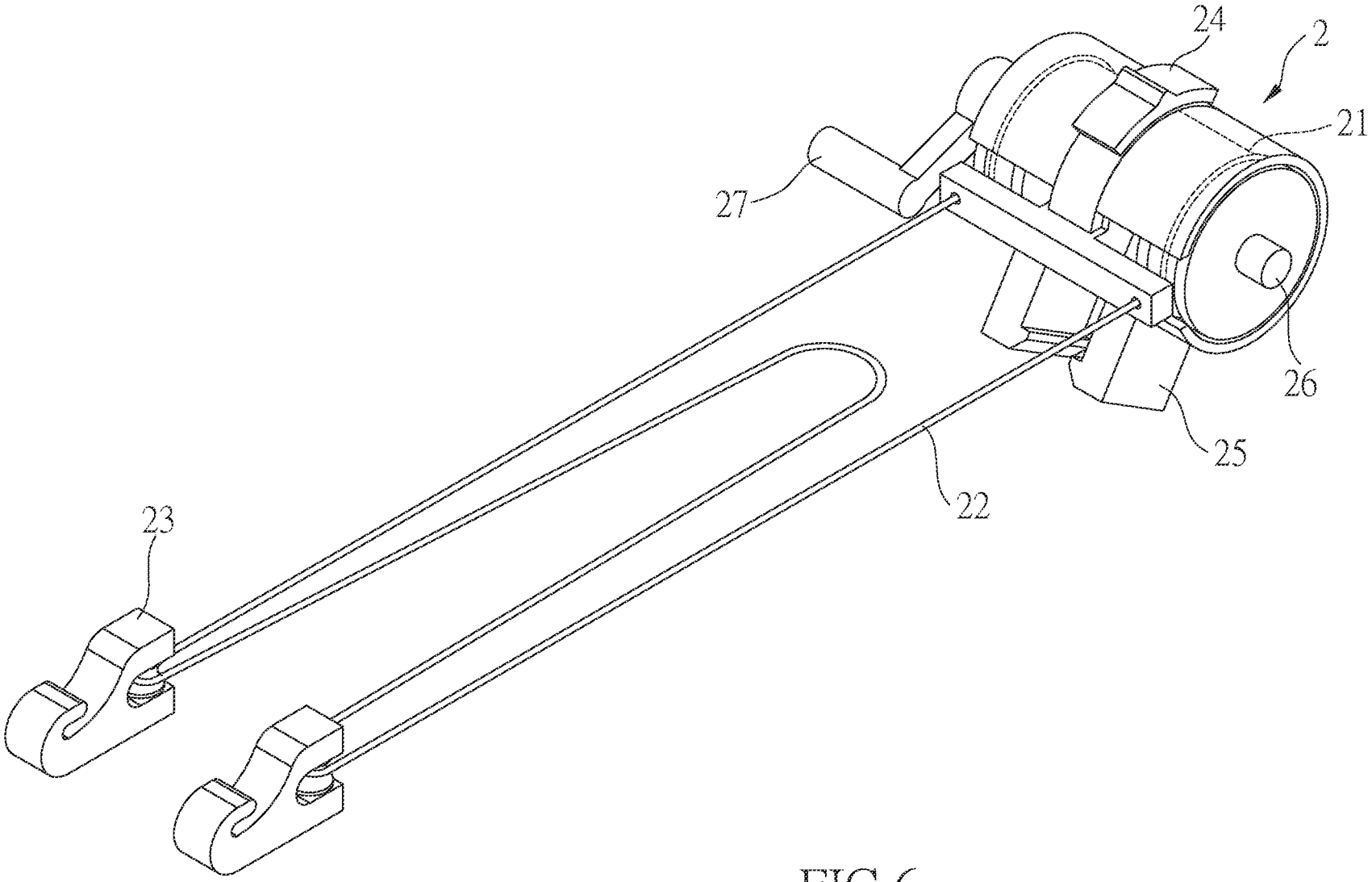
FIG. 6 is a schematic view of a bowstring drawing assistance device in an expanded status, according to the present invention.
Figure 7:
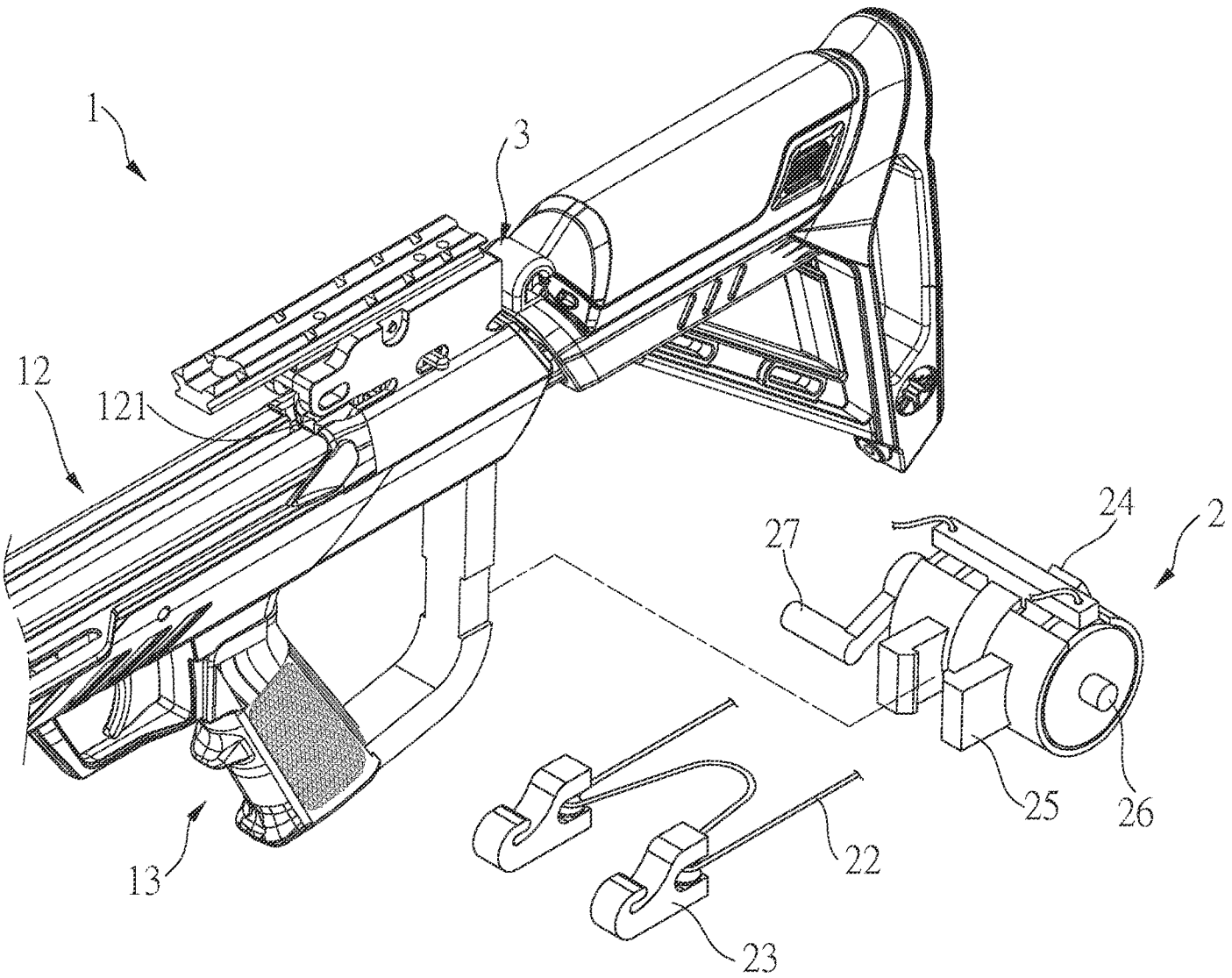
FIG. 7 is an exploded view of a bowstring drawing assistance device and a handle part of the present invention.

As shown in FIGS. 5 and 6, the bowstring drawing assistance device 2 includes a reeling assembly 21, a pull wire 22 and a pull hook 23; the pull wire 22 is inserted through the pull hook 23 to connect to the reeling assembly 21.

As shown FIGS. 1 to 4, the wire separator assembly 3 is disposed on the crossbow 1; in this embodiment, the wire separator assembly 3 is implemented by an engaging hook disposed on the frame part 12. The wire separator assembly 3 is configured to separate, restrain and engage the pull wire 22 to form a bowstring drawing structure between the pull hook 23 and the wire separator assembly 3.

Figure 2:
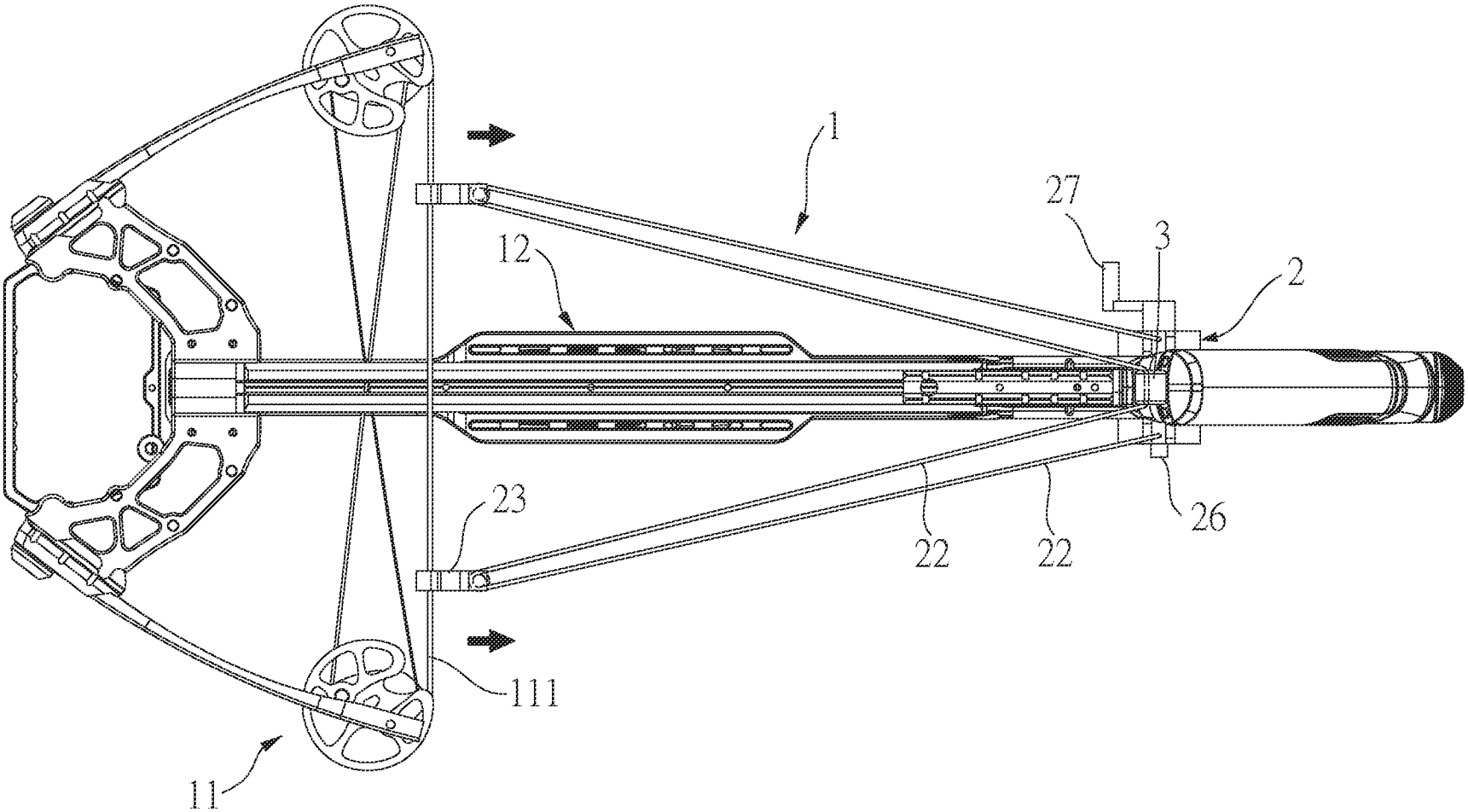
FIG. 2 is a top view of an embodiment in which a bow is not drawn yet, according to the present invention.
Figure 3:
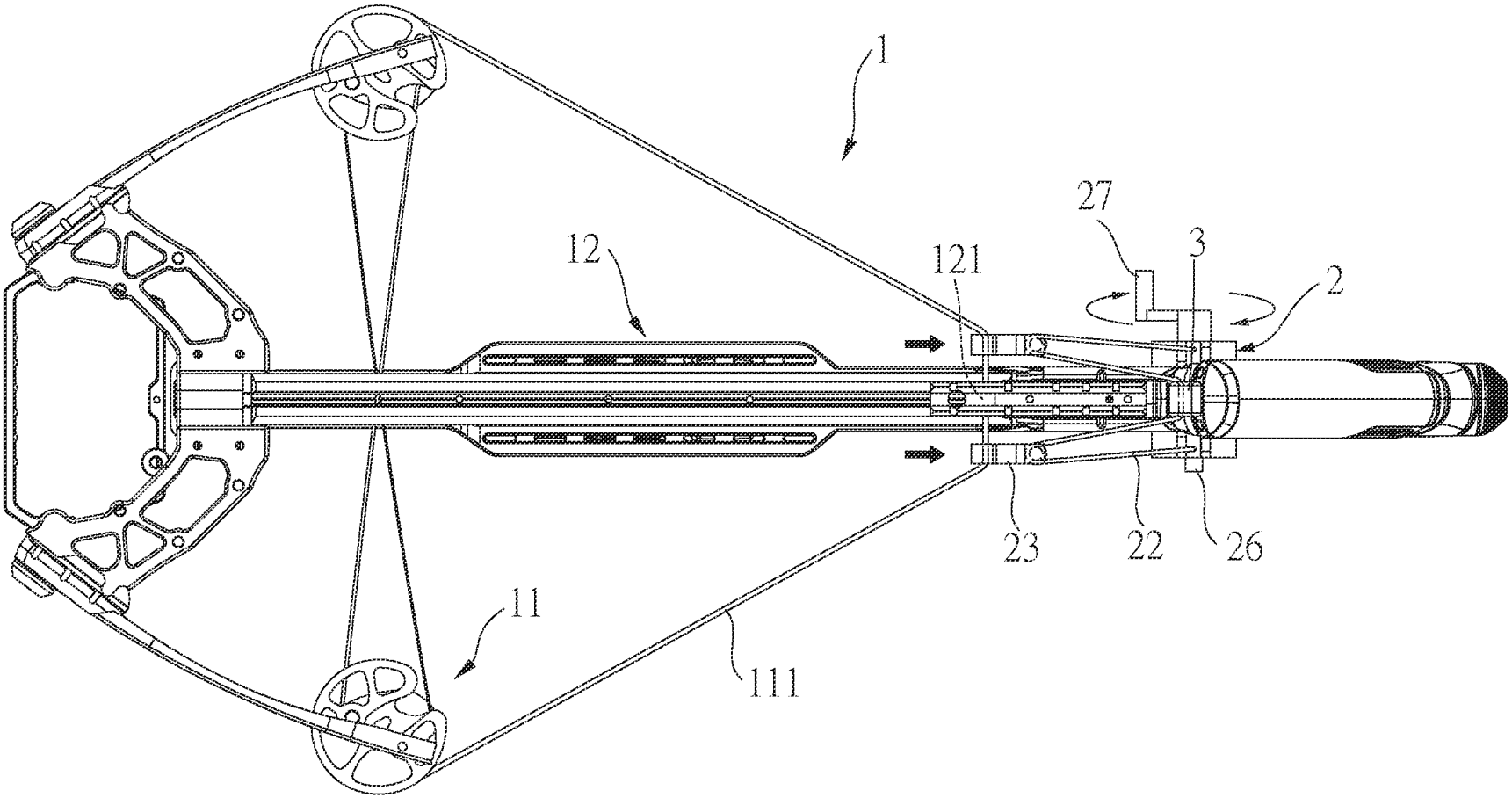
FIG. 3 is a top view of an embodiment in which a bow is drawn, according to the present invention.
Figure 4:
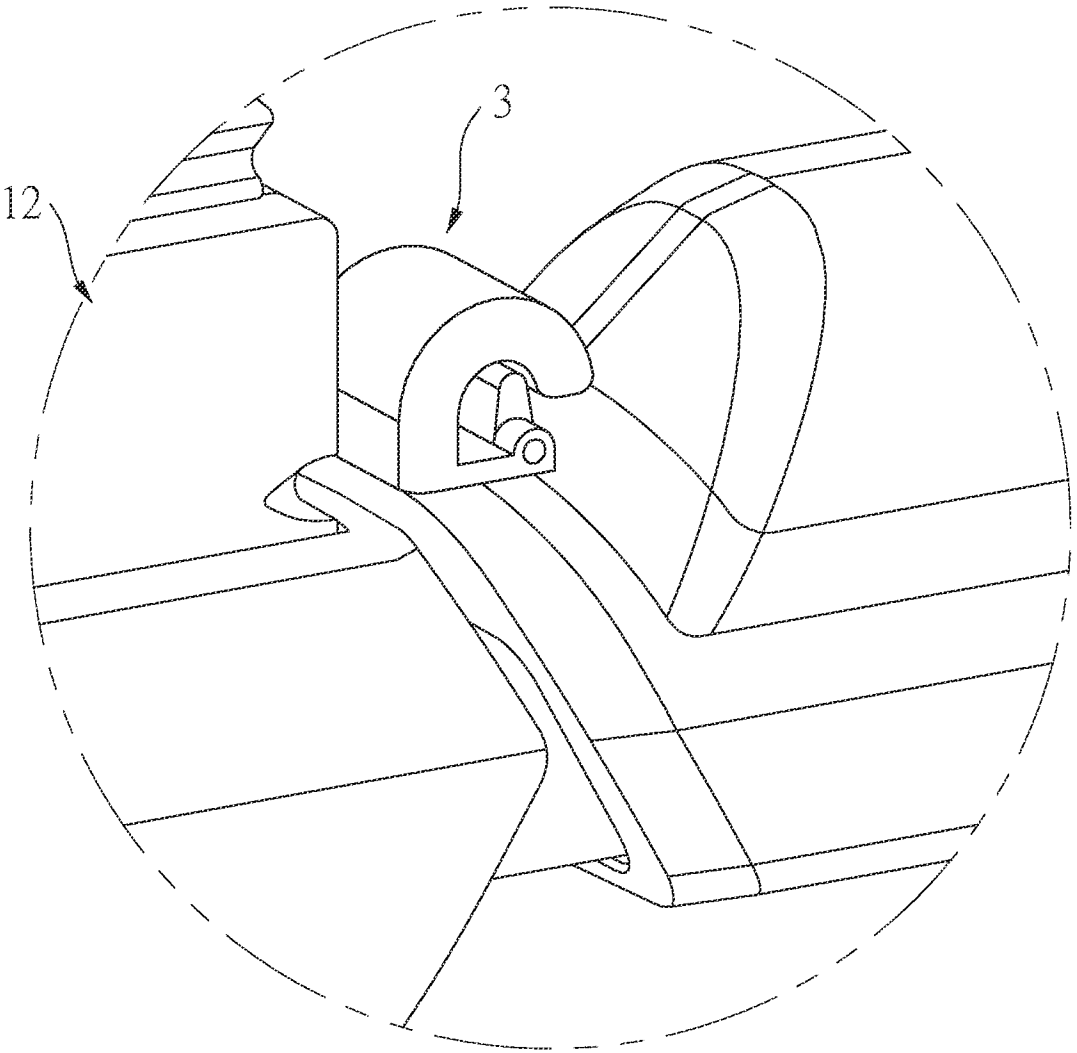
FIG. 4 is a partially enlarged view of a position where a wire separator assembly is mounted in an embodiment of the present invention.

As shown in FIGS. 1 to 3, when the pull hook 23 hooks the bowstring 111 to locate the pull wire 22 on the wire separator assembly 3, the reeling assembly 21 can be operated to pull back and pack the pull wire 22 located two sides of the crossbow 1 and pull the through the pull hook 23, so as to move the bowstring 111 toward the wire separator assembly 3 until the bowstring 111 is engaged on the engaging member 121, thereby completing the whole drawing operation.

In practical use, as shown FIGS. 1 to 7, in order to use the crossbow string drawing assistance system, a user can mount the bowstring drawing assistance device 2 at any position on the crossbow 1, for example, in this embodiment, the bowstring drawing assistance device 2 is mounted on the handle part 13; next, the user can use the pull hook 23 to hook the bowstring 111, and draw the pull wire 22 between the two pull hooks 23 backward to engage with the wire separator assembly 3 on the crossbow 1. After the above-mentioned operations are completed, the user can operate the reeling assembly 21 to pull back and pack the pull wire 22, and during the process of pulling back the pull wire, the pull wire 22 between the wire separator assembly 3 and the two pull hooks 23 is stretched and gradually reduce the length, so as to drive the bowstring 111 to move toward the wire separator assembly 3 until the pull wire 22 is engaged on the engaging member 121, thereby completing the whole drawing operation.

The aforementioned contents are the main technical features of the main embodiment of the present invention, and the main technical features correspond to content of claim 1 of the patent invention, to explain the purpose and implementation of the present invention in detail; the technical features described in the dependent claims are the detailed description of the content of claim 1 or appended technical features, and not to limit the scope of claim 1 of the patent invention. It should be noted that claim 1 is not necessarily to include the technical features described in dependent claims.

The feature of components of the present invention will be described in detail with reference to FIGS. 1 to 7. The bowstring drawing assistance device 2 of the present invention includes a blocking assembly 24, when the blocking assembly 24 is opened, the blocking assembly 24 blocks the reeling assembly 21 to prevent the pull wire 22 from being pulled back by the bowstring 111.

As shown FIGS. 1 to 7, the bowstring drawing assistance device 2 of the present invention includes a mounting part 25; in this embodiment, the mounting part 25 is implemented by a pawl. The mounting part 25 is configured to mount the bowstring drawing assistance device 2 on the crossbow 1.

As shown FIGS. 1 to 7, the bowstring drawing assistance device 2 of the present invention includes a rotating pin 26. The rotating pin 26 is connected to the reeling assembly 21, and configured to drive the reeling assembly 21 to pull back and pack the pull wire 22 by a rotation manner.

In addition, as shown FIGS. 1 to 7, the bowstring drawing assistance device 2 of the present invention includes a rotating handle 27, the rotating handle 27 is combined with the rotating pin 26 to assist the reeling assembly 21 to pack the pull wire 22 in a labor-saving manner.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. A crossbow string drawing assistance system, comprising:

a crossbow comprising a bow part, a frame part and a handle part, wherein the bow part is disposed on a section of the frame part and comprises a bowstring, the handle part is connected to another section of the frame part, the frame part comprises an engaging member;

a bowstring drawing assistance device disposed on the crossbow, and comprising a reeling assembly, a pull wire and a pull hook, wherein the pull wire is inserted through the pull hook to connect to the reeling assembly; and a wire separator assembly disposed on the crossbow, and configured to separate and restrain the pull wire, to form a bowstring drawing structure between the pull hook and the wire separator assembly;

wherein when the pull hook hooks the bowstring to locate a part of the pull wire in the wire separator assembly, the reeling assembly is configured to draw back and pack the pull wire located two sides of the crossbow, to draw the bowstring to move toward the wire separator assembly through the pull hook until the bowstring is engaged with the engaging member, so as to complete a drawing operation.

2. The crossbow string drawing assistance system according to claim 1, wherein the bowstring drawing assistance device comprises a blocking assembly, when the blocking assembly is opened, the blocking assembly blocks the reeling assembly to prevent the pull wire from being pulled back to the original position when the bowstring drawing assistance device is operated to pack the pull wire.

3. The crossbow string drawing assistance system according to claim 1, wherein the bowstring drawing assistance device comprises a mounting part, the mounting part is configured to mount the bowstring drawing assistance device on the crossbow.

4. The crossbow string drawing assistance system according to claim 1, wherein the bowstring drawing assistance device comprises a rotating pin, the rotating pin is connected to the reeling assembly and configured to drive the reeling assembly to pull back and pack the pull wire by a rotation manner.

5. The crossbow string drawing assistance system according to claim 4, wherein the bowstring drawing assistance device comprises a rotating handle, the rotating handle and the rotating pin are combined to assist the reeling assembly to pull back and pack the pull wire.

* * * * *